United States Patent [19]

Banks

[11] 3,963,124

[45] June 15, 1976

[54] WEB OF RECORD ASSEMBLIES

[75] Inventor: Paul J. Banks, Dayton, Ohio

[73] Assignee: Monarch Marking Systems, Inc., Dayton, Ohio

[22] Filed: Jan. 10, 1975

[21] Appl. No.: 540,043

Related U.S. Application Data

[62] Division of Ser. No. 281,591, Aug. 17, 1972, Pat. No. 3,885,334.

[52] U.S. Cl. ..... 206/527; 206/390; 206/820; 40/2 R

[51] Int. Cl.[2] ..... B65D 73/00; G09F 3/10

[58] Field of Search ..... 206/527, 820, 411, 390; 229/70; 40/2 R, 21 R, 125 A

[56] References Cited

UNITED STATES PATENTS

| | | | |
|---|---|---|---|
| 1,755,128 | 4/1930 | Peters | 40/2 R |
| 2,091,346 | 8/1937 | Wright | 40/2 R |
| 2,121,865 | 6/1938 | Flood | 40/2 R |
| 2,346,219 | 4/1944 | Johnson | 206/411 |
| 3,183,614 | 5/1965 | Loderhose | 229/70 |

*Primary Examiner*—William T. Dixson, Jr.
*Attorney, Agent, or Firm*—Joseph J. Grass

[57] ABSTRACT

There are disclosed various embodiments of record assembly webs. The record assembly webs are formed into separable record assemblies. Each assembly includes a record that can be applied to merchandise. One record part of the record can be readily removed from another part using one hand.

23 Claims, 12 Drawing Figures

FIG-1
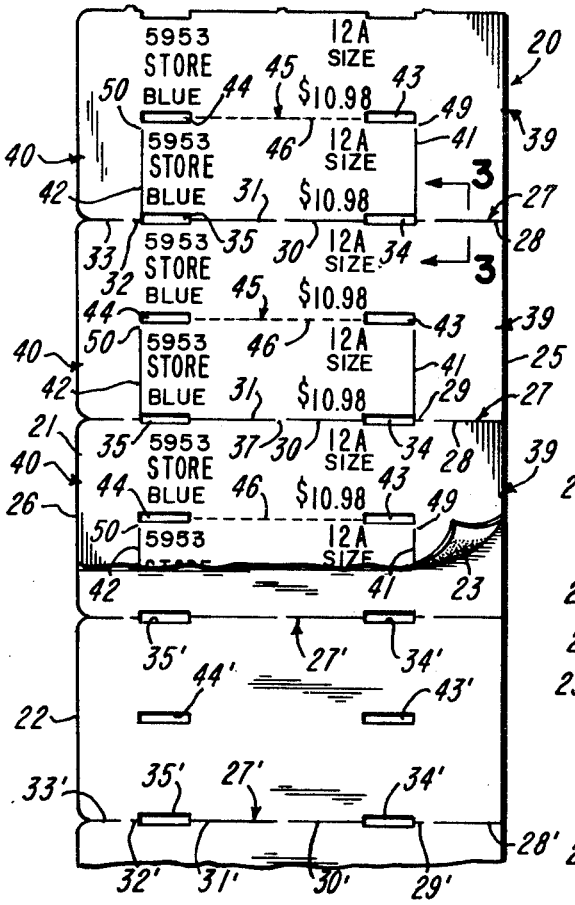
FIG-2
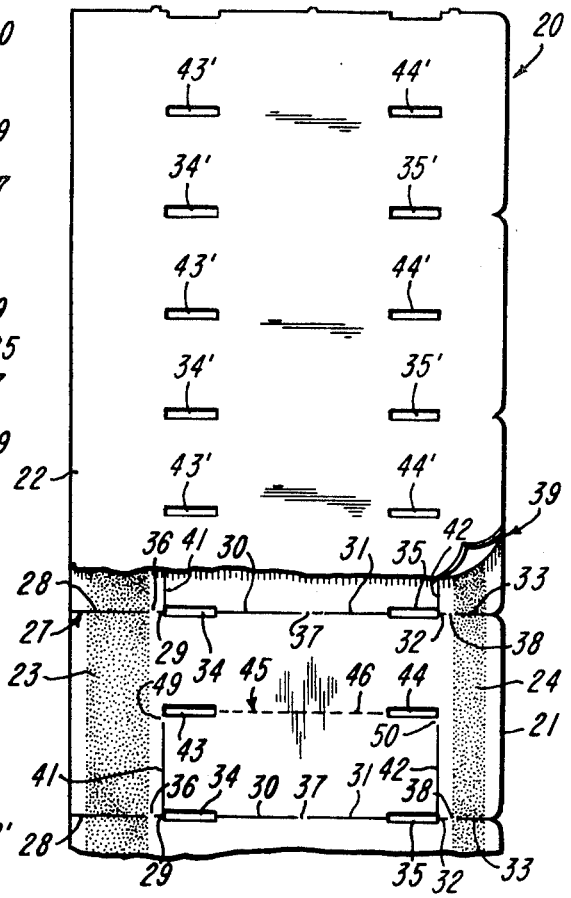
FIG-4
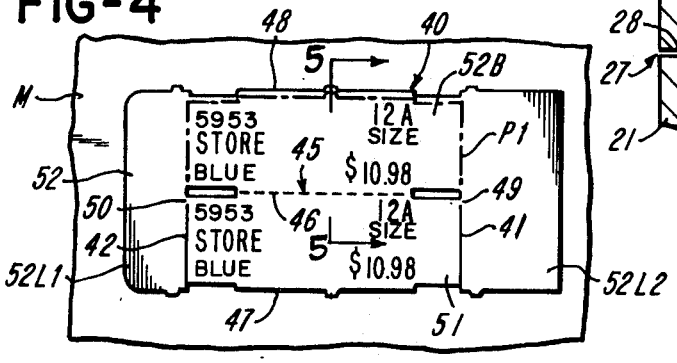
FIG-3
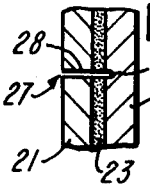
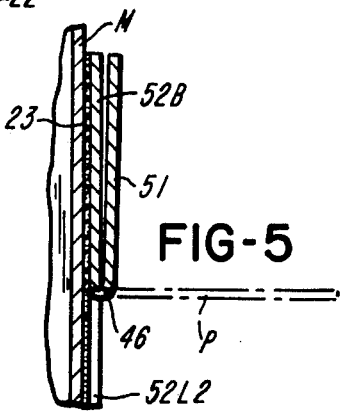
FIG-5
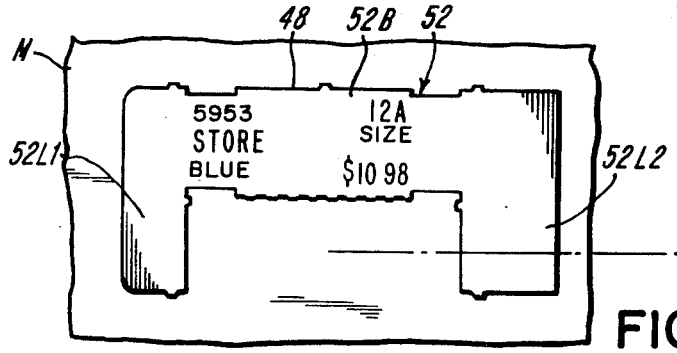
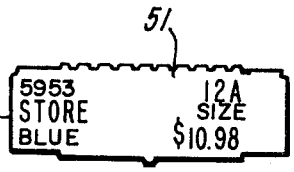
FIG-6

WEB OF RECORD ASSEMBLIES

CROSS-REFERENCE TO RELATED APPLICATION

This is a division of pending application Ser. No. 281,591, filed Aug. 17, 1972, now U.S. Pat. No. 3,885,334.

This invention relates to the art of record assemblies.

SUMMARY OF THE INVENTION

The invention resides in a record assembly having a recorrd that can be attached to merchandise by means of its pressuresensitive adhesive, and yet one of its record parts can be readily removed from another record part using only the thumb and index finger of one hand. This is facilitated by one or more cuts extending at one end to one end of the record; there is also a line of partial severing in the record. The cut or cuts and the partial severing form the removable record part. It is preferred to use a frangible portion to hold the one record part in the plane of the other record part until the one record part is pivoted about the partial severing and the frangible part is torn.

BRIEF DESCRIPTION OF THE DRAWINGS

FIG. 1 is a top plan view of a web of record assemblies in accordance with one embodiment of the invention, with some of the records broken away to show the web of backing material;

FIG. 2 is a bottom plan view of the web of record assemblies shown in FIG. 1, with some of the backing material broken away to expose the underside of the record material web;

FIG. 3 is a sectional view taken generally along line 3—3 of FIG. 1;

FIG. 4 is an elevational view of one of the records applied to merchandise;

FIG. 5 is an enlarged sectional view taken generally along line 5—5 of FIG. 4;

FIG. 6 is an elevational view similar to FIG. 4, but showing one record part removed from another record part;

DETAILED DESCRIPTION OF THE PREFERRED EMBODIMENTS

Figure 7:
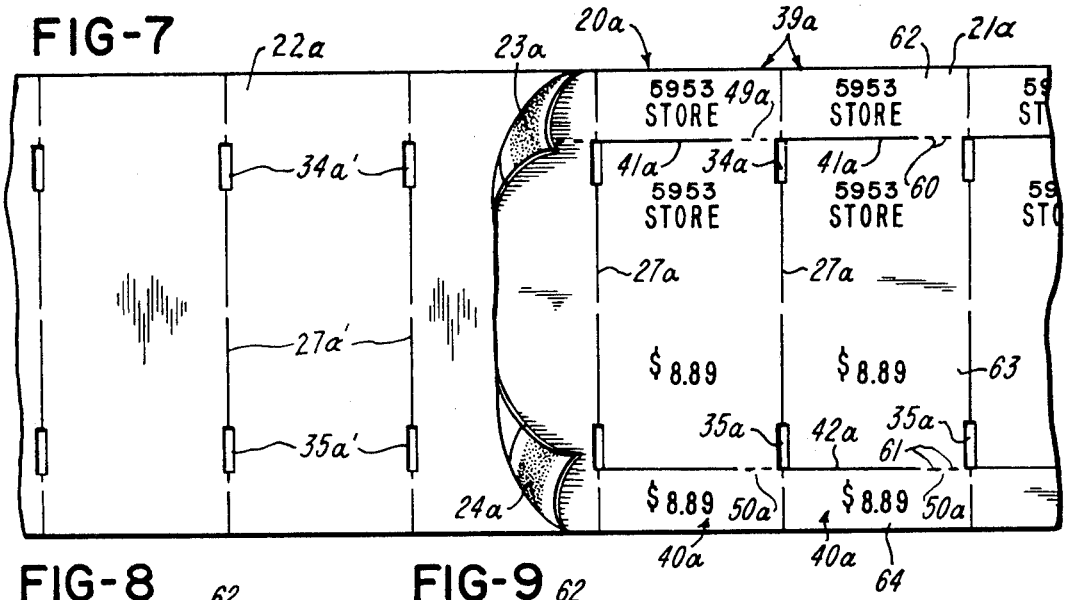
FIG. 7 is a top plan view of a web of record assemblies in accordance with another embodiment of the invention.
Figure 8:
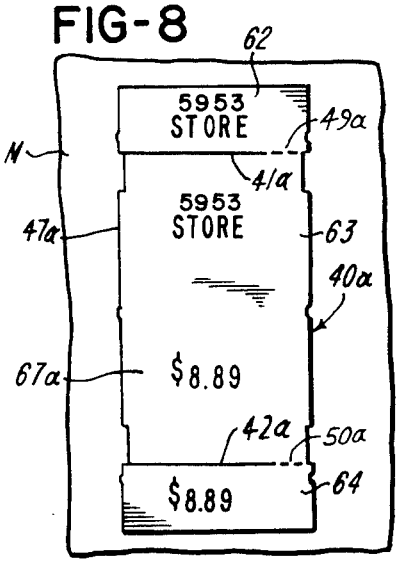
FIG. 8 is an elevational view of a record shown in FIG. 7 having been applied to merchandise.
Figure 9:
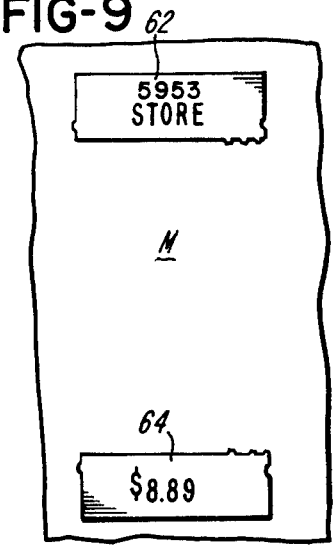
FIG. 9 is an elevational view similar to FIG. 8, but showing one record part as having been removed.
Figure 10:
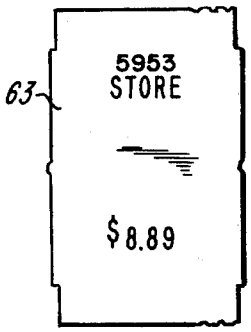
FIG 10 is an elevational view showing the removed record part.

Referring to the embodiment of FIGS. 1 through 6, and initially to FIGS. 1 and 2, there is shown a record assembly web generally indicated at 20. The web 20 is shown to include a longitudinally extending web of record material 21 and a longitudinally extending web of backing material 22. The record material web 21 has transversely spaced-apart continuous longitudinally extending zones of pressure-sensitive adhesive 23 and

24 closely spaced from but near respective side edges 25 and 26 of the record material web 21.

The record material web 21 is shown to be transversely partially severed as generally indicated at 27 along longitudinally spaced-apart transverse lines. The backing material 22 is also partially severed as generally indicated at 27' and exists along the same transverse lines. The partial severing 27 in the record material web 21 is illustrated as being formed by through-cuts 28 to 33, inclusive, and elongated holes 34 and 35. A frangible uncut portion 36 exists between the through-cuts 28 and 29, a frangible uncut portion 27 exists between the through-cuts 30 and 31, and a frangible uncut portion 38 exists between the through cuts 32 and 33. The partial severing 27' in the backing material web 22 is illustrated as comprising cuts 28' and 33', inclusive, which preferably penetrate the backing material web 22 as best shown in FIG. 3. Holes 34' and 35' which are aligned with the holes 34 and 35, are shown to extend through the web 22. The through-cuts 28 to 33, inclusive and the holes 34 and 35 preferably extend through the record material web 21, as shown.

The partial severing 27 can alternatively be complete severing entirely across the record material web 21, as by having through-cuts extend through the frangible portions 36, 37 and 38, in which event the backing material web 22 would preferably not even be penetration cut as illustrated at 28' to 33', inclusive. While this alternative construction is suitable when the record material is relatively thin, paper label stock, in the event the record material is relatively stiff such as paper ticket or tag stock, cuts in the backing material 22 are preferably omitted as they tend to diminish the integrity of the web 20.

The lines of partial severing 27 and 27' transform the web 20 into a plurality of separable record assemblies 39. The records or record members 40 can be separable from the web 20 together with the underlying backing material 22 because of the partial severing 27'. The records 40 can also be peeled from the backing material 22 in which event the cuts 28' through 33' are not used in that the backing material 22 is not severed.

The record material 21 is provided with groups of through-cuts 41 and 42. There is shown to be one group of throughcuts 41 and 42 in each record 40. The cuts 41 and 42 are shown to extend in the longitudinal direction and to be spaced from the side edges 25 and 26 of the record material 21. The one ends of the cuts 41 and 42 extend to the partial severing 27, and more particularly to the end of respective holes 34 and 35. The other ends of the cuts 41 and 42 of each group terminate short of elongated transverse spaced-apart holes 43 and 44 in the record material web 21. Aligned holes 43' and 44' are also cut through the backing material 22. The elongated sets of holes 43 and 44 form part of the partial severing generally indicated at 45 which extends transversely at longitudinally spaced-apart locations. The partial severing 45 includes perforation cuts 46 which extends parallel to end edges 47 and 48 of the record 40 and perpendicularly to side edges 25 and 26. The partial severing 45 between the other ends of the cuts 41 and 42 of each group is considered to include respective frangible uncut portions 49 and 50. The through-cuts 41 and 42 and the partial severing 45 forms each record into record parts 51 and 52, the record part 51 being removable from the record part 52. The record part 52 is generally U-shaped and has leg portions 51L1 and 52L2 joined by bight portion 52B. The adhesive 24 exists on the leg portion 52L1 and the adhesive 23 exists on the leg portion 52L2, there being no adhesive on the bight portion 52B. The adhesive 23 is outboard of and closely spaced from the cuts 41 and the holes 34 and 43, and the adhesive 24 is outboard of the closely spaced from the cuts 42 and the holes 35 and 44.

In use, the web 20 can be fed through a recorder such as an imprinter using the feed holes 34, 34'; 35, 35'; 43, 43'; and 44, 44'.

With reference to FIG. 4, one of the records 40, having been removed from its backing material 22, is shown applied to a box or merchandise M. The record 40 is secured to the merchandise M by means of the adhesive 23 and 24. Both record parts 51 and 52 contain identical imprinting as shown in FIGS. 1, 4 and 6. The record part 51 can be removed by the sales clerk at the point-of-sale and retained for inventory control uses, while the record part 52 remains secured to the merchandise M. It is preferred that the record material be constructed of relatively stiff ticket or tag stock. The record part 51 can be removed by inserting a thumb fingernail under the record part 51 at the end 47, and using the record part 51 like a lever to swing it from the position shown in FIG. 4, through the position shown by phantom lines P and into the portion shown by phantom lines P1 in FIG. 4 and by solid lines in FIG. 5. In that the record part 51 pivots about the line of perforation cuts 46, the frangible portions 48 and 49 are thereby torn. Thereupon, the record part 51 is moved back to the position shown by phantom line P (FIG. 5), and by using the thumb and index finger of the one hand the record part 51 is removed by tearing it along the perforation cuts 46.

The cuts 41 and 42 are shown to extend a substantial distance between end 47 and holes 43 and 44. In the illustrated embodiment in which the frangible portions 49 and 50 are uncut the through-cuts 41 and 42 are preferably at least about five times longer than the respective frangible portions 49 and 50. The through-cuts 41 and 42, or either of them, can be shortened if the frangible portions are partially severed but in that event the cuts 41 and 42 should preferably not be shorter than the respective frangible portions.

With reference to the embodiment of FIGS. 7 through 10, a record material web generally indicated at 20*a* includes a web of record material 21a and a web of backing material 22*a* removably secured to each other by continuous longitudinal zones of pressure-sensitive adhesive 23*a* and 24*a*. The record material web 21*a* is partially severed transversely as indicated at 27a along longitudinally spaced-apart transverse lines and the backing material web 22*a* is partially severed transversely as indicated at 27*a'* along the same transverse lines to form separable record assemblies 39*a*. Transversely spaced-apart holes 34a and 35*a* through the record material 21*a* along the transverse lines and aligned holes 34*a'* and 35*a'* in the backing material 22*a* can serve as feed holes for advancing the web 20*a* through the recorder.

Groups of through-cuts 41*a* and 42*a* through the record material 21*a* extend at their one ends to the partial severing 27*a* which constitutes one end of the respective record assembly 39*a*. The other ends of the cuts 41*a* and 42*a* are spaced from the opposite end of the respective record assembly 39*a* by frangible portions 49*a* and 50*a*. The frangible portions 49*a* and 50*a* are shown to be longer than the frangible portions 49 and 50 of the embodiment of FIGS. 1 through 6, but are provided with short through-cuts 60 and 61. If desired the through-cuts 60 and 61 can be eliminated and in this event it is preferred that the cuts 41*a* and 42*a* be longer making the frangible portions 49*a* and 50a correspondingly shorter. Through-cuts 41*a* and 42*a* and the partial severing provided by cuts 60 and 61 form the record 40a into record parts 62, 63 and 64. The record part 63 is removable from the record parts 62 and 64 which are secured to the merchandise M (FIG. 8) by means of the pressure-sensitive adhesive 23*a* and 24*a*. To separate the record part 63 from the record parts 62 and 64, the thumb fingernail of the user's one hand is inserted under one end 47*a* of the record part 67*a*. In that the record material 22*a* of which the record assemblies 40*a* are comprised is preferably relatively stiff, as is ticket or tag stock material, lifting of the second part 63 out of the plane of the record parts 62 and 64 results in the record part 63 tending to pivot about the frangible portions 49*a* and 50*a*. The user grasps the record part 63 between his thumb and index fingers of his one hand and with gentle pulling, the record part 63 is separated from the record parts 62 and 64. Prior art records in which partial severing exists along the same longitudinal lines where the through-cuts 41a and 42a exit are not readily separable using one hand as in the present invention wherein the through-cuts 41*a* and 42*a* extend to the end of the record 40*a*. In this embodiment if it is desired to have through-cuts at each end of the record part 63, then the frangible portions would be between these through-cuts.

The through-cuts 41*a* and 42*a* are shown to extend distances several times greater than the length of the respective frangible portions 49*a* and 50*a*. The cuts 41*a* and 42*a* can be relatively short in the event the record material 22*a* is relatively flexible label stock.

Figure 11:
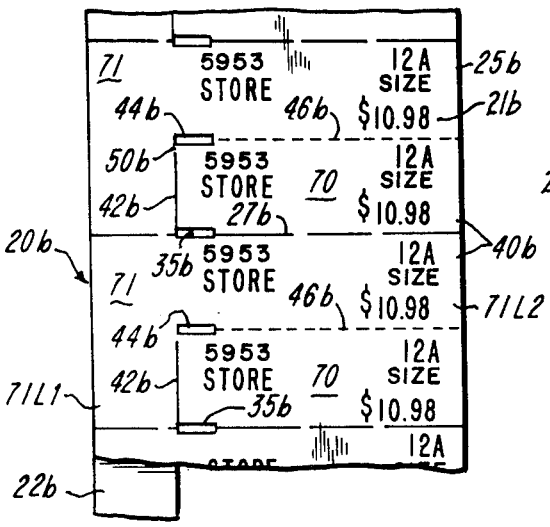
FIG. 11 is a top plan view of a web of record assemblies in accordance with another embodiment of the invention.
Figure 12:
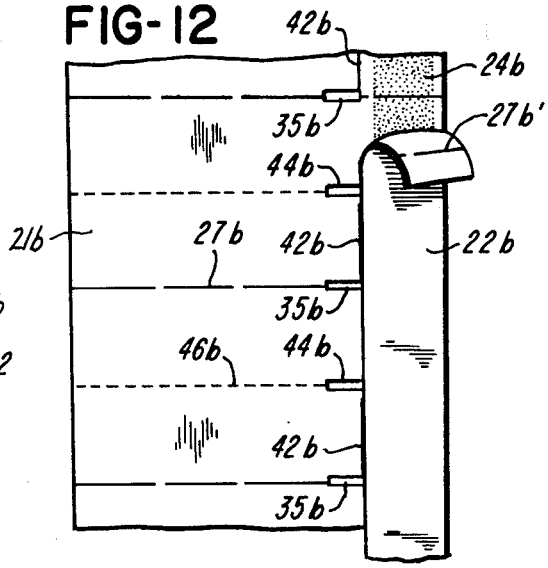
FIG. 12 is a bottom plan view of the record assembly web shown in FIG. 11.

In the embodiment of FIGS. 11 and 12, a record assembly web generally indicated at 20*b* includes a web of record material 21*b* and a web of backing material 22*b* removably secured to each other by a continuous longitudinal zone of pressure-sensitive adhesive 24*b*. The record material web 21*b* is partially severed transversely as indicated at 27*b* along longitudinally spacedapart transverse lines but the backing material 22*b* can be partially severed as indicated at 27*b'* along the same transverse lines. Feed holes 35b are disposed along the transverse lines, and feed holes 44b are spaced between the transverse lines.

Through-cuts 42b through the record material 21b extend at their one ends to the transverse line of partial severing at one end of the respective record 40*b*. The other end of each cut 42*b* is spaced from the respective hold 44*b* by a frangible uncut portion 50*b*. Lines of perforation cuts 46*b* extend from the respective hole 44b to side edge 25*b* of the record 40b. The line of perforation cuts 46*b* is considered to form part of the partial severing between the other end of the respective cut 42*b* and the side edge 25*b* of the respective record 40*b*. Once a record 40b has been separated from the remainder of the web 20*b* and its underlying backing material 22*b* it can be attached to merchandise by means of adhesive 24b and the record part 70 formed by the cut 42*b*, the hole 44*b*, and the perforation cuts 46*b*, can be readily separated from the record part 72 in the same manner as the record part 51 is separated from the record part 52. The record part 72 is generally L-shaped and has legs 72L1 and 72L2. The adhesive **24*b* is on the leg 72L1 and there is no adhesive on the leg L2L2. The adhesive 24*b* is outboard of the cuts 42*b* and holes 35*b* and 44*b*. Prior art records in which partial severing exists along the same longitudinal lines wherer the through cut 42*b* exists are not readily separable using one hand as in the present invention wherein the through-cut extends to the end of the record 40*b*.**

Each cut **42*b* is shown to extend a substantial distance between record part end 47*b* and the respective hole 44*b*. In the illustrated embodiment in which the record material 22*b* is relatively stiff ticket or tag stock and which the frangible portion 50b is uncut, the through-cut 42*b* is preferably at least about four times longer than the respective frangible portion 50*b*. The through-cut 42*b* of each record 40*b* can be shortened if the frangible portion 50*b* is partially severed but in that event the cut 42*b* should preferably not be shorter than the respective frangible portions, however, in the event paper lable stock which is relatively flexible is used, the through-cut 42*b*** can be shorter.

Other embodiments and modifications of this invention will suggest themselves to those skilled in the art, and all such of these as come within the spirit of this invention are included within its scope as best defined by the appended claims.

I claim:

1. A web of record assemblies, comprising: a longitudinally extending web of record material, a web of backing material, and pressure-sensitive adhesive releasably adhering the web of record material and the web of backing material to each other, the record material web being at least partially severed along longitudinally spaced-apart transverse lines to provide a plurality of record assemblies, a plurality of groups of cuts through the record material of each record assembly, the cuts of each group extending at their one ends to a respective transverse line, and means partially severing the record material between the other ends of each group to provide a removable record part in each record assembly.

2. A web of record assemblies as defined in claim 1, wherein the pressure-sensitive adhesive is coated onto the record material web in two longitudinally extending zones outboard of the groups of cuts.

3. A web of record assemblies as defined in claim 2, wherein the removable record part is generally rectangular and the remainder of the record assembly is generally U-shaped.

4. A web of record assemblies as defined in claim 3, including a frangible portion of record material between the other end of at least one of the cuts of each group and the means partially severing the record material which tends to keep one record part and the other record part in the same plane.

5. A web of record assemblies as defined in claim 1, wherein the partial severing means includes an elongated hole.

6. A web of record assemblies as defined in claim 1, wherein the removable record part is generally rectangular and the remainder of the record assembly is generally U-shaped.

7. A web of record assemblies as defined in claim 1, wherein the backing material is partially severed along the transverse lines.

8. A web of record assemblies as defined in claim 1, including a frangible portion of record material between the other end of at least one of the cuts of each group and the means partially severing the record material which tends to keep the one record part and the other record part in the same plane.

9. A web of record assemblies comprising: a longitudinally extending web of record material, a longitudinally extending web of backing material, pressure-sensitive adhesive releasably adhering the web of record material and the web of backing material to each other, the record material being partially severed along longitudinally spaced-apart lines to provide a plurality of record assemblies, a plurality of groups of cuts through the record material of each record assembly, the cuts of each group extending at their one ends to a respective transverse line, and means partially severing the record material between the other ends of each group so that each record assembly has a plurality of record parts, one record part being removable and another record part having a pair of spaced-apart zones of the pressure-sensitive adhesive.

10. A web of record assemblies as defined in claim 9, wherein the partial severing means includes an elongated hole.

11. A web of record assemblies as defined in claim 9, wherein the other record part of each record assembly is generally U-shaped, and one of the pressure-sensitive adhesive zones is on each leg of the U.

12. A web of record assemblies as defined in claim 9, including a frangible portion of record material between the other end of at least one of the cuts of each group and the means partially severing the record material which tends to keep the one record part and the other record part in the same plane.

13. A web of record assemblies, comprising: a longitudinally extending web of record material, a longitudinally extending web of backing material, pressure-sensitive adhesive releasably adhering the web of record material and the web of backing material to each other, the record material being partially severed along longitudinally spaced-apart first transverse lines to provide a plurality of separable record assemblies, each record assembly having a through-cut extending at its one end to one of the first transverse lines, and partial severing extending along a second transverse line between the other end of each cut and one side edge of the record material web, thereby providing separable record parts, the pressure-sensitive adhesive being on one of the record parts, and each through-cut extending generally perpendicular to the partial severing along the respective second transverse line.

14. A web of record assemblies as defined in claim 13, including a frangible portion of record material between the other end of the cut and the means partially severing the record material which tends to keep the one record part and the other record part in the same plane.

15. A web of record assemblies as defined in claim 13, wherein the partial severing means includes an elongated hole.

16. A web of record assemblies, comprising: a longitudinally extending web of record material, a longitudinally extending web of backing material, pressure-sensitive adhesive releasably adhering the web of record material and the web of backing material to each other, the record material being partially severed along longitudinally spaced-apart transverse lines to provide a plurality of record assemblies, a plurality of longitudinally extending transversely spaced-apart cuts through the record material of each record assembly, the through-cuts of one group extending at their one ends to the respective transverse line which defines one end of the respective record assembly, the record material between the other ends of the through-cuts comprises a frangible portion thereby forming a removable record part, and the pressure-sensitive adhesive being on each record assembly outboard of the removable record part.

17. A web of record assemblies as defined in claim 16, wherein one frangible portion includes a perforation cut.

18. A web of record assemblies as defined in claim 16, wherein the record material between the other ends of the through-cuts further comprise an elongated hole.

19. A web of record assemblies, comprising: a web of relatively stiff record material, a web of backing material, pressure-sensitive adhesive releasably securing the record material web to the backing material web, first means for partially severing the record material web generally transversely at longitudinally spaced-apart intervals to provide end edges of separable record assemblies, the record material of each record assembly comprising a record having a pair of elongated through-cuts, one of the ends of the through-cuts extending to the same transversely extending end edge of the record, second means partially severing the record between the other ends of the through-cuts, thereby dividing the record into first and second record parts, the first record part being pivotal about the second partial severing means and being removable from the second record part by tearing along the second partial severing means, the second record part having the pressure-sensitive adhesive for adhering the second record part to merchandise, the first record part being free of adhesive, and the backing material being releasably adhered to the adhesive on the underside of the second record part.

20. A web of record assemblies, comprising: a web of relatively stiff record material, a web of backing material, pressure-sensitive adhesive releasably securing the record material web to the backing material web, first means for partially severing the second material generally transversely at longitudinally spaced-apart intervals to provide end edges of separable record assemblies, the record material of each record assembly comprising a record having a pair of elongated through-cuts extending to the same end edge of the record, second means partially severing the record between the other ends of the through-cuts, thereby dividing the record into a generally rectangular first record part and a generally U-shaped second record part, a frangible portion between the other end of at least one of the through-cuts and the second partial severing means which tends to keep the first and second record parts in the same plane, the first record part being pivotal about the second partial severing means and being removable from the second record part by tearing along the second partial severing means, the second record part having the pressure-sensitive adhesive on its underside, the first record part being free of adhesive, and the backing material being releasably adhered to the adhesive on the underside of the second record part.

21. A web of record assemblies as defined in claim 20, wherein each record has a frangible portion between the second partial severing means and each of the ends of the through-cuts.

22. A web of record assemblies, comprising: a web of relatively stiff record material, a web of backing material, pressure-sensitive adhesive releasably securing the record material web to the backing material web, first lines of partial severing in the record material at longitudinally spaced-apart intervals to provide end edges of separable record assemblies, the record material of each record assembly comprising a record having a pair of side edges and a pair of end edges, an elongated through-cut in each record, one end of the through-cut extending to one of the end edges of the record, a second line of partial severing in each record extending generally parallel to the end edges and extending from near the other end of the respective through-cut to one side edge of the record assembly, thereby dividing the record into first and second record parts, a frangible portion between the other end of the through-cut and the second line of partial severing which tends to keep the first and second record parts in the same plane, wherein the through-cut is at least about four times longer than the frangible portion, the first record part being pivotal about the line of partial severing and being removable from the second record part by tearing along the second line of partial severing, the second record part having the pressure-sensitive adhesive on its underside, the first record part being free of adhesive, and the backing material being releasably adhered to the adhesive on the underside of the second record part.

23. A web of record assemblies, comprising: a web of relatively stiff record material, a web of backing material, pressure-sensitive adhesive releasably securing the record material web to the backing material web, first means for partially severing the record material at longitudinally spaced-apart intervals to provide end edges of separable assemblies, the record material of each record assembly comprising a record, each record having a pair of elongated through-cuts, the one ends of the through-cuts extending to the respective first partial severing means, frangible portions between the other ends of the through-cuts and another edge of the record, thereby dividing the respective records into first and second record parts and an intervening third record part, the respective through-cuts extending through distances several times greater than the lengths of the respective frangible portions, pressure-sensitive adhesive on the undersides of the first and second record parts, the backing material being releasably adhered to the adhesive on the first and second record parts, and the third record part being readily removable from the first and second record parts by pivoting the third record part and thereby tearing the respective frangible portions.

* * * * *

UNITED STATES PATENT AND TRADEMARK OFFICE

CERTIFICATE OF CORRECTION

PATENT NO. : 3,963,124

DATED : June 15, 1976

INVENTOR(S) : Paul J. Banks

It is certified that error appears in the above-identified patent and that said Letters Patent are hereby corrected as shown below:

Column 1, line 14, "pressuresensitive" should be --pressure-sensitive--. Column 2, line 12, "27" should be --37--; line 17, "and" should be --to--; line 46, "throughcuts" should be --through-cuts--. Column 3, line 7, "the" (first occurrence) should be --and--. Column 5, line 6, "wherer" should be --where--; line 14, after "and" --in-- has been omitted. Column 8, line 42, after "separable" --record-- has been omitted.

Signed and Sealed this

Nineteenth Day of October 1976

[SEAL]

*Attest:*

RUTH C. MASON
*Attesting Officer*

C. MARSHALL DANN
*Commissioner of Patents and Trademarks*